United States Patent [19]

Arndt

[11] Patent Number: 4,981,434

[45] Date of Patent: Jan. 1, 1991

[54] DRYER OR OVEN OF THE RADIANT BURNER TYPE

[76] Inventor: H. Chandler Arndt, 500 Auckland La., Matthews, N.C. 28105

[21] Appl. No.: 381,579

[22] Filed: Jul. 18, 1989

[51] Int. Cl.[5] ..... F27B 9/28

[52] U.S. Cl. ..... 432/59; 431/328; 34/41

[58] Field of Search ..... 432/59; 34/23, 41, 49, 34/155, 151; 431/328

[56] References Cited

U.S. PATENT DOCUMENTS 4,589,843 5/1986 Smith ..... 432/59

*Primary Examiner*—Henry A. Bennet

*Attorney, Agent, or Firm*—Shefte, Pinckney & Sawyer

[57] ABSTRACT

A dryer or oven of the type utilizing radiant burners having a heating chamber extending therethrough with opposed sides in which radiant burner units are arranged in spaced rows with enclosure panels therebetween. The burner units face opposed panels and the panels are formed with radiantly refelective surfaces for re-radiation of heat from the burner units into the heating chamber. In one form, a dryer is formed with T-shaped modules, each having narrow vertical sections and top cross-sections for joining in face-to-face relation to adjacent units, with exterior access spaces between the vertical sections and with the burner units having back sides exteriorly exposed in the spaces for convenient access. In another form, an oven is formed with burner units and enclosure panels extending in a longitudinal horizontal heating chamber that is open along its top for passage therethrough of articles suspended from a conveyor.

13 Claims, 8 Drawing Sheets

DRYER OR OVEN OF THE RADIANT BURNER TYPE

BACKGROUND OF THE INVENTION

The present invention relates to a dryer or oven of the type utilizing radiant burners and through which a substrate is conveyed for drying or otherwise heating.

Prior dryers or ovens of this general type have radiant burners mounted within the enclosure of a housing to confine the heating generated by the burners. The walls of the housing are conventionally made of insulating material such as felted ceramic fiber mats. One aspect of the present invention provides an improvement by utilizing radiantly reflective surfaces on wall panels facing the burners for efficient reflective re-radiation of heat from opposed burner units. This is particularly advantageous when the housing is relatively narrow and the panels are arranged directly opposite the burner units for most efficient re-radiation. An example of the less efficient prior art is found in Smith U.S. Pat. Nos. 4,604,054 and 4,722,681, which disclose radiant burners in ovens having housings with felted ceramic fiber mats rather than radiantly reflective panels, and particularly do not teach or suggest such panels in opposition to radiant burners.

In drying or heating a continuous length of material, such as textile fabrics, the material may travel in a sinuous path through a housing along parallel path segments with burners arranged in facing relation to each path. In such an arrangement it is conventional for all of the burners to be contained in a single housing without partitions, resulting in the heat being dissipated throughout the housing and not concentrated on the traveling material. In contrast, one of the aspects of the present invention involves arranging the radiant burners and opposed radiantly reflective panels in narrow parallel chambers through which the material passes in a sinuous path, thereby confining the heat and avoiding the dissipation in a large housing, and also allowing the backs of the burners to be exposed outside the chambers in a relatively cool condition for ease of servicing by access in the space between adjacent chambers.

SUMMARY OF THE INVENTION

Briefly described, the present invention provides a dryer or oven of the type utilizing radiant burners. A supporting framework defines a heating chamber extending through the framework with at least two opposed sides. A plurality of radiant burner units are mounted in spaced rows on the framework on opposed sides of the heating chamber. The burner units have burner surfaces facing into the heating chamber and have fuel conduits and control valves disposed exteriorly of the chamber. Enclosure panels are mounted on the framework substantially contiguous with the rows of burner units between the burner surfaces and the exterior conduits and valves and extend from the rows of burner units to substantially enclose the opposed sides of the heating chamber. The panels in each side of the heating chamber are disposed for receiving heat radiated from the burner unit in an opposite side of the heating chamber. Each panel has a radiantly reflective surface facing interiorly of the chamber and a backing layer of insulating material. Thus, the panels provide reflective re-radiation of heat from the opposed burner units into the chamber. Further, means are provided for conveying a substrate through the chamber to be dried or heated therein.

Preferably, opposite rows of burner units are transversely offset out of alignment so that the radiantly reflective panels are directly opposite burner units for efficient operation.

Also preferably, the chamber is formed with two closely spaced opposed sides having the rows of burner units therein, thereby providing a narrow chamber through which the substrate is conveyed and in which the heat is efficiently applied. In one form, each of the rows of burner units extends transverse to the direction of substrate conveyance for application of heat across the width of the substrate.

In a preferred embodiment, the rows of burner units and opposed radiantly reflective panels are disposed in a plurality of spaced parallel modules and the substrate conveying means conveys the substrate sequentially through the modules. In this arrangement the modules are spaced sufficiently to allow access to the burner units exteriorly of the modules for servicing and replacement, which can be done efficiently and expeditiously as the exterior of the burner units are relatively cool as well as being easily accessible. In this arrangement, the modules preferably have vertically extending sections containing the chambers with the chamber in each of the modules having two vertically extending opposed sides containing the burner units and between which the substrate is conveyed vertically, with the vertical module sections being arranged in parallel, horizontally spaced relation. To provide an exhaust plenum chamber with this modular arrangement, the modules are formed T-shaped with horizontally extending upper sections providing horizontally extending exhaust plenum chambers and the upper sections of adjacent modules are connected end-to-end with a resulting access space between the adjacent vertically extending sections. Thus, the upper sections of the modules form a common exhaust plenum across the top of the oven or dryer.

In another form of the present invention, the heating chamber extends generally horizontally and has at least three at least partially opposed sides extending generally horizontally with a longitudinally extending horizontal upper opening extending between adjacent sides for extension of the conveying means therethrough. Preferably, the sides of the chamber adjacent the opening are inclined to dispose the burner units to face at a downward inclination. In the preferred embodiment, one of the at least three sides is disposed below the conveyed substrate and faces upwardly toward the opening. This form of the invention has particular application in heating three dimensional objects that are conveyed through the chamber.

DETAILED DESCRIPTION OF THE PREFERRED EMBODIMENTS

Figure 1:
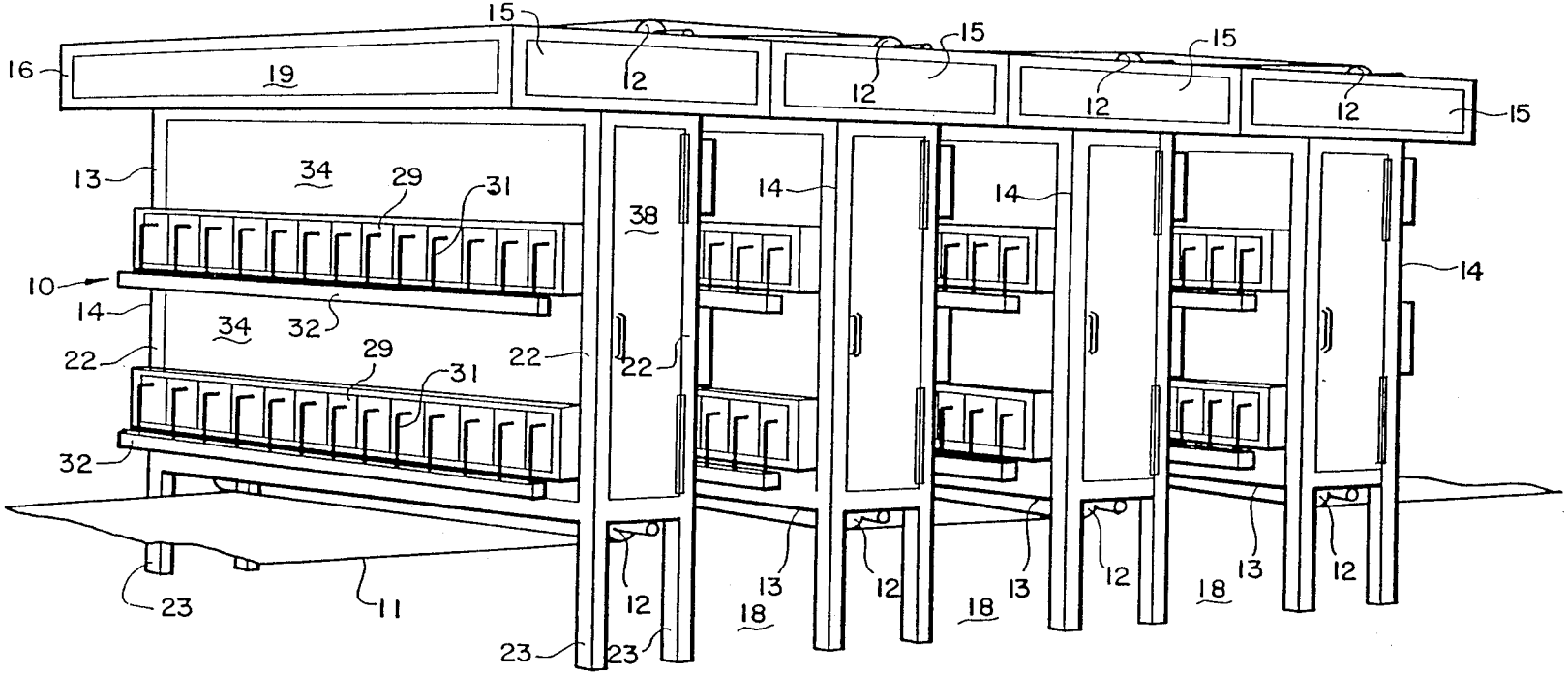
FIG. 1 is a perspective view of a multi-path textile fabric dryer according to a preferred embodiment of the present invention.
Figure 2:
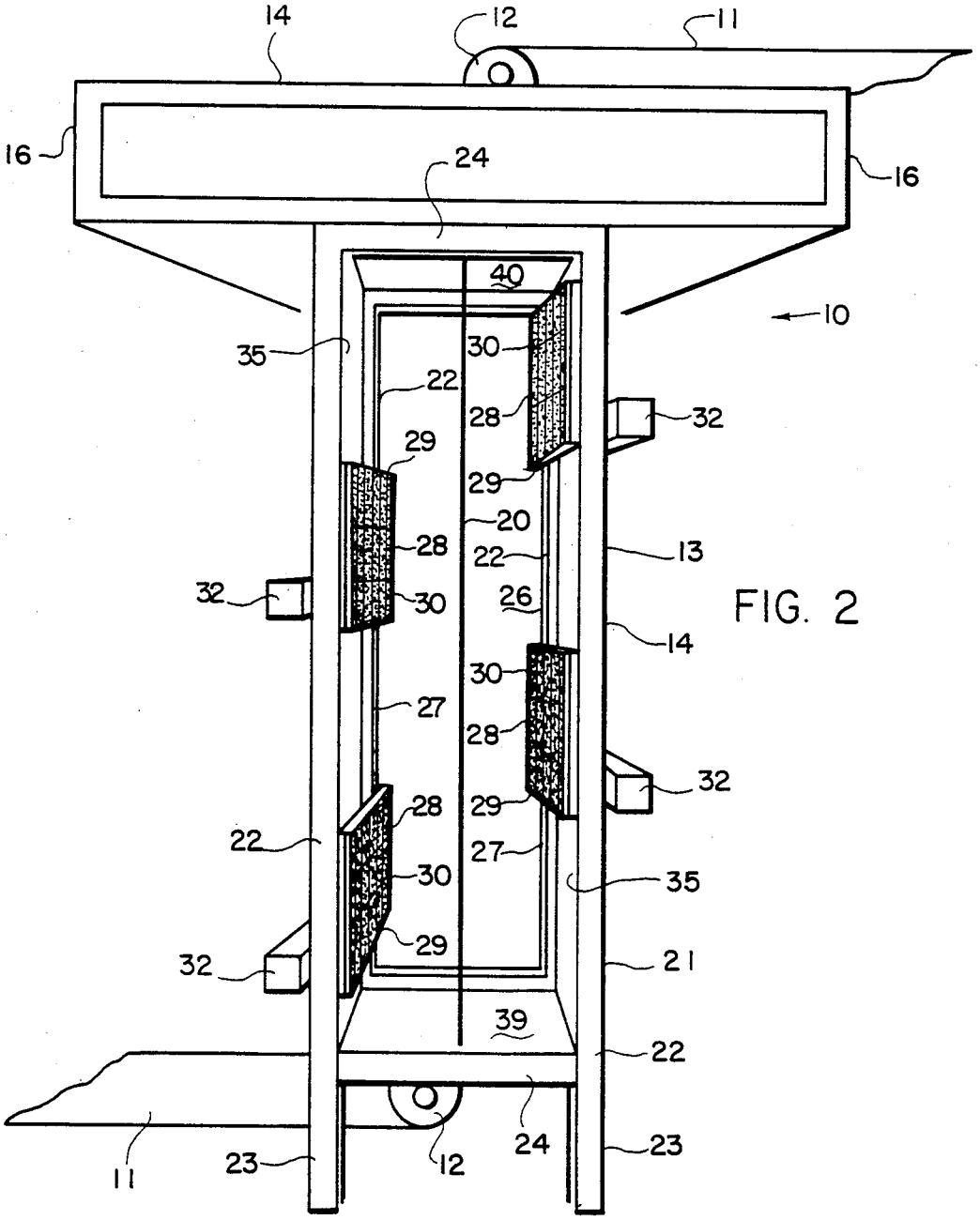
FIG. 2 is a perspective view of the interior of one chamber of the dryer of FIG. 1.
Figure 3:
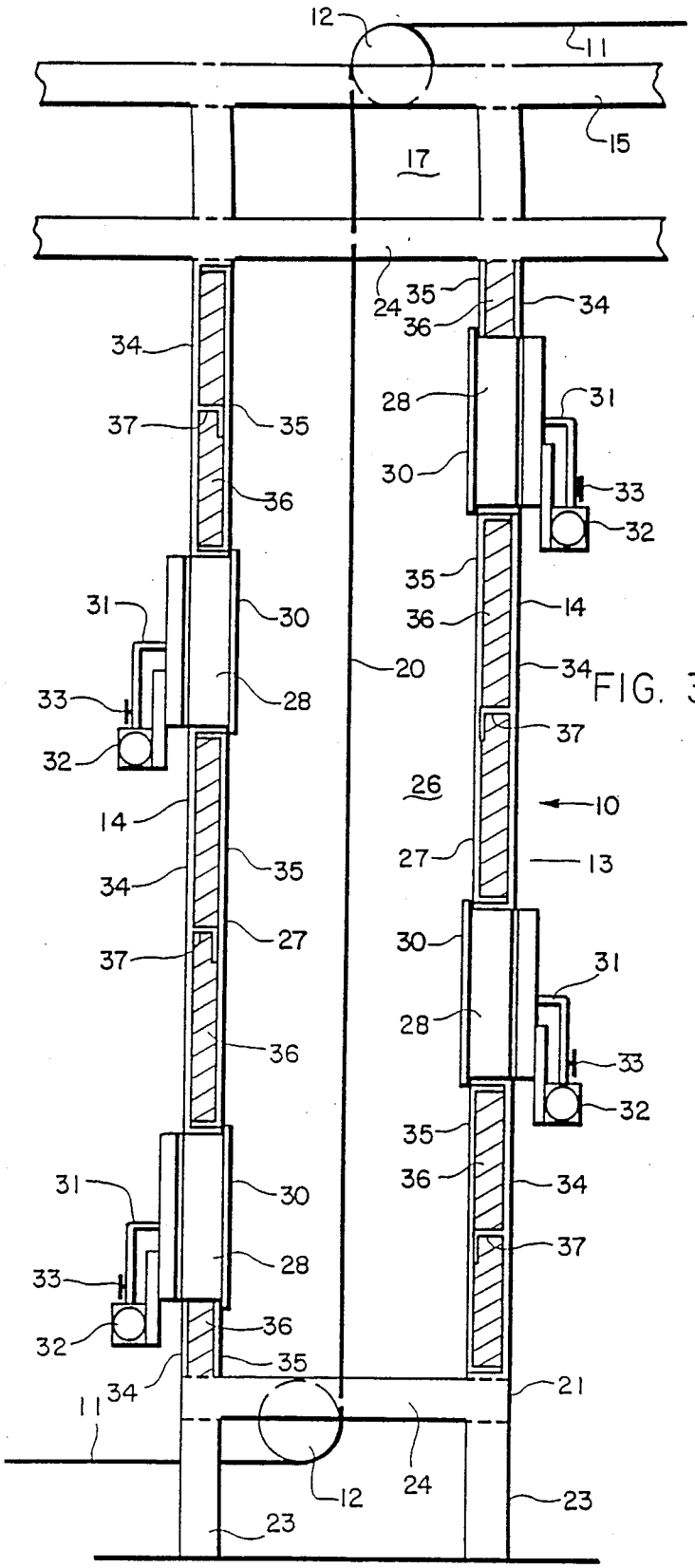
FIG. 3 is a vertical transverse section through one of the chambers of the dryer of FIG. 1.
Figure 4:
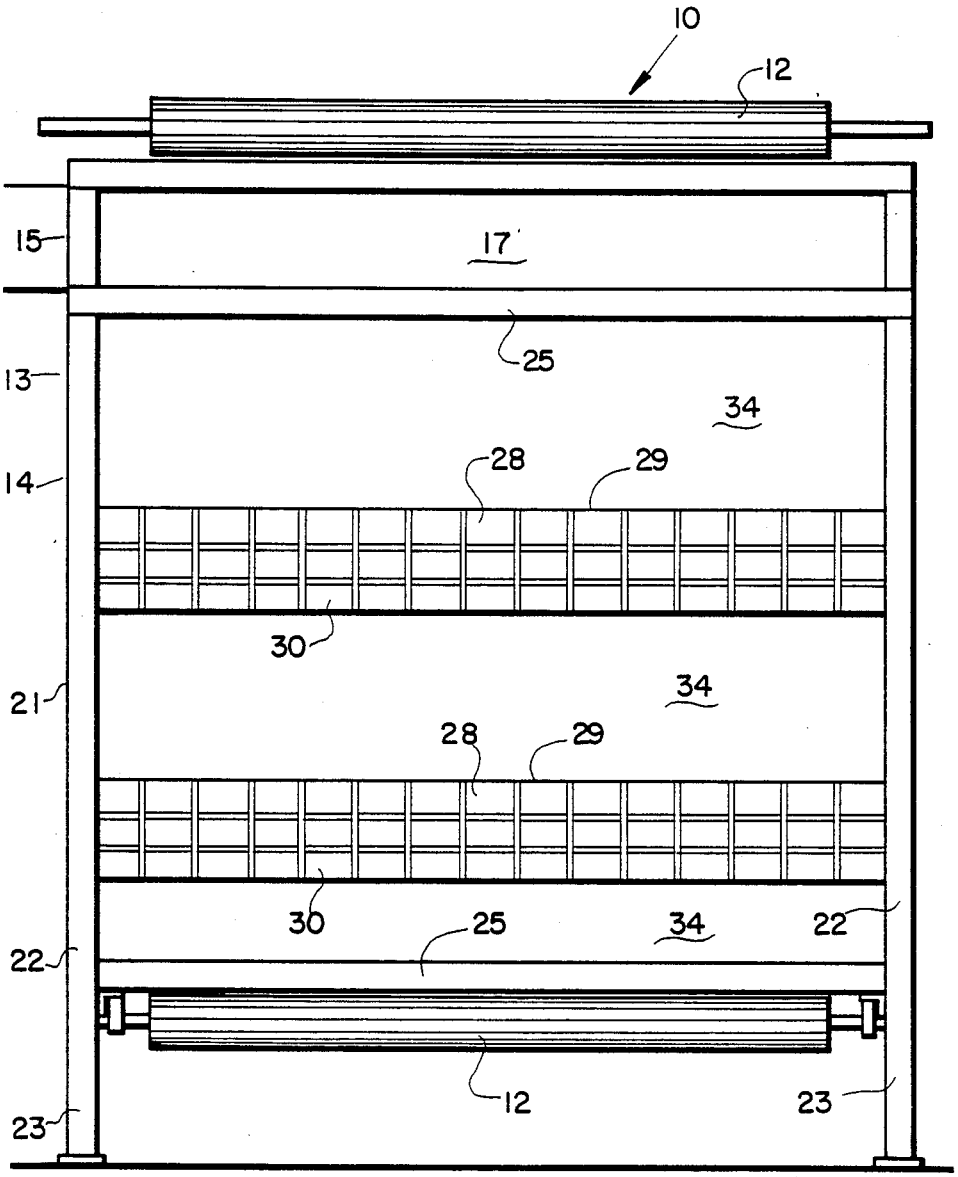
FIG. 4 is an elevation of the interior face of the wall of one of the chambers of the dryer of FIG. 1 as viewed along line 4—4 in FIG. 1.
Figure 5:
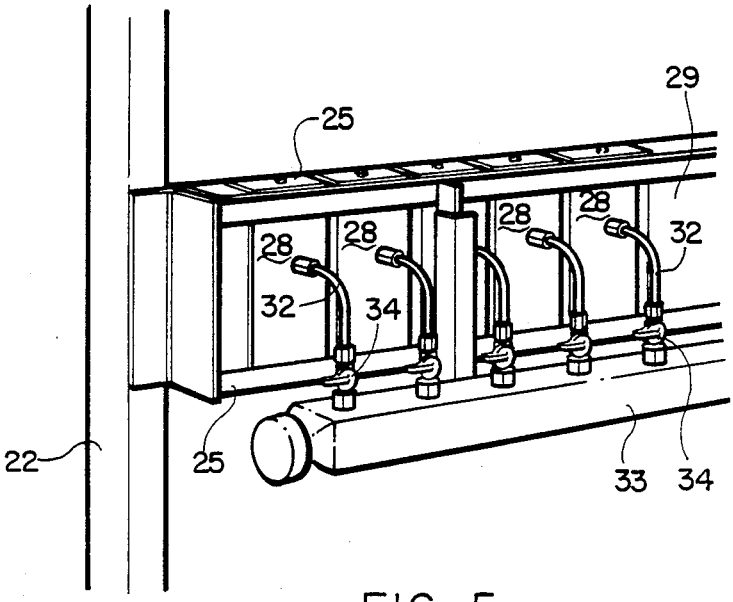
FIG. 5 is an enlarged perspective view of a portion of the exterior of a chamber of the dryer of FIG. 1.

Referring first to the embodiment of FIGS. 1–6, the present invention is incorporated in a dryer 10 used as a pre-dryer in a textile fabric range wherein a substrate 11 in the form of a continuous length of textile fabric is fed over rollers 12 through the dryer 10 in a sinuous path sequentially through a plurality of parallel, vertical, closely spaced modules 13.

Each module 13 is T-shaped, having a vertical section 14 and an upper section 15, with adjacent modules 13 having the ends 16 of their upper sections 15 connected in end-to-end relation to form an exhaust plenum 17 and to result in an exterior access space 18 between vertical sections 14 of adjacent modules 13. With this arrangement any desired number of modules can be connected to form a desired dryer configuration with the outer ends 19 of the upper sections 15 of the first and last modules 13 being closed.

As illustrated in FIG. 1, the substrate 11 is fed to the dryer horizontally and is directed vertically around a roller 12 through the first module 13, above which it is directed around a roller 12 to the next module 13 at which it is directed around another roller 12 to pass vertically in the opposite direction through the adjacent module 13, below which it again passes around a roller 12 to travel horizontally to the next module 13, which path 20 continues as the substrate 11 progresses through the dryer 10 and around the last roller to leave the dryer 10 in a horizontal direction.

Each of the vertical sections 14 of the modules 13 have a supporting framework 21 that includes corner posts 22 extending to provide legs 23 for supporting the vertical sections 14 above the floor. These corner posts 22 are square metal channels. Cross bars 24 connect the corner posts 23 at each end of the vertical section 14 at the top and bottom. The opposite ends of each module 13 are connected and supported by transversely extending horizontal metal bars 25, which complete the supporting framework 21 and define a heating chamber 26 extending through the module 13 between two opposed sides 27 of the module 13.

The transverse bars 25 support a plurality of radiant burner units 28 mounted thereon in horizontally extending spaced rows 29 on opposed sides 27 of the heating chamber 26. These radiant burner units 28 are of the type disclosed in U.S. Pat. No. 4,628,900 and are mounted in a similar manner as disclosed therein for individual removal and insertion as needed for servicing and replacement. These burner units 28 have burner surfaces 30 facing into the heating chamber 26 and have fuel conduits 31 individually connected on their back sides exteriorly of the heating chamber 26 and connected through control valves 33 to a fuel manifold 32 exteriorly of the heating chamber 26.

Enclosure panels 34 are mounted on the framework 21 substantially contiguous with the rows 29 of burner units 28 between the burner surfaces 30 and the exterior fuel conduits 31 and control valves 33. These enclosure panels 34 extend between and from the rows 29 of burner units 28 to substantially enclose the opposed sides 27 of the heating chamber 26. These enclosure panels 34 in each side 27 of the heating chamber 26 are disposed for receiving heat radiated from burner units 28 in an opposite side of the heating chamber 26 and, for this purpose, are formed with a radiantly reflective metal surface 35 facing interiorly of the chamber 26 and a backing layer 36 of insulating material for reflective re-radiation of heat from the opposed burner units 28 into the chamber. The backing layer 36 in the embodiment illustrated is a high density rigid block of fiberglass with a stiffening rib 37 extending transversely through the mid portion of the larger panels.

As illustrated, the rows 2 of burner units 28 extend horizontally and transversely to the direction of the path of the substrate 11, with the rows 29 of opposed sides 27 being transversely offset out of facing alignment so that the rows 29 of burner units 28 face the radiantly reflective surfaces 35 of opposed enclosure panels 34 for efficient re-radiation of heat within the chamber 26.

The opposed sides 27 of the heating chamber 26 are closely spaced to provide a narrow chamber for confinement of the heat and, thereby, efficient application of heat to the substrate as it is conveyed through the chamber 26. The vertical end of each heating chamber 26 is closed by an access door 38. The chambers 26 are, therefore, completely enclosed except for the bottom openings 39 and top openings 40 through which the substrate 11 is conveyed and with the top openings 40 opening into the exhaust plenum 17 for exhaust of heated gas therethrough.

With the construction as described, no insulation is necessary for the burner units, fuel conduits 31, fuel manifolds 32 and control valves 33, and because these components are exteriorly disposed with respect to the heating chambers 26, they are not heated to the same extent that they would be if they were mounted within the chambers and it is, therefore, possible to accomplish servicing and replacement relatively quickly without the long cooling periods necessary with dryers of the type in which burner units are mounted completely within an oven. This exterior disposition of these components, and the simple individual mounting and replacement characteristics as disclosed in the aforesaid prior U.S. Pat. No. 4,628,900, result in replacement of burner units being possible in as short a time as five minutes as compared with between an hour and a day with prior completely enclosed dryers.

In a specific application, the heating chamber 26 can be constructed with the opposed sides 27 spaced, for example, twelve inches apart for increased efficiency of heat application and air flow. With such an arrangement, a textile substrate 11 can be run at 125 yards per minute, which is approximately twice as fast as in prior pre-dryers.

Further, if narrow width goods are being processed, individual burner units 28 can be shut off so that only burner units facing the substrate need be in operation.

Figure 6:
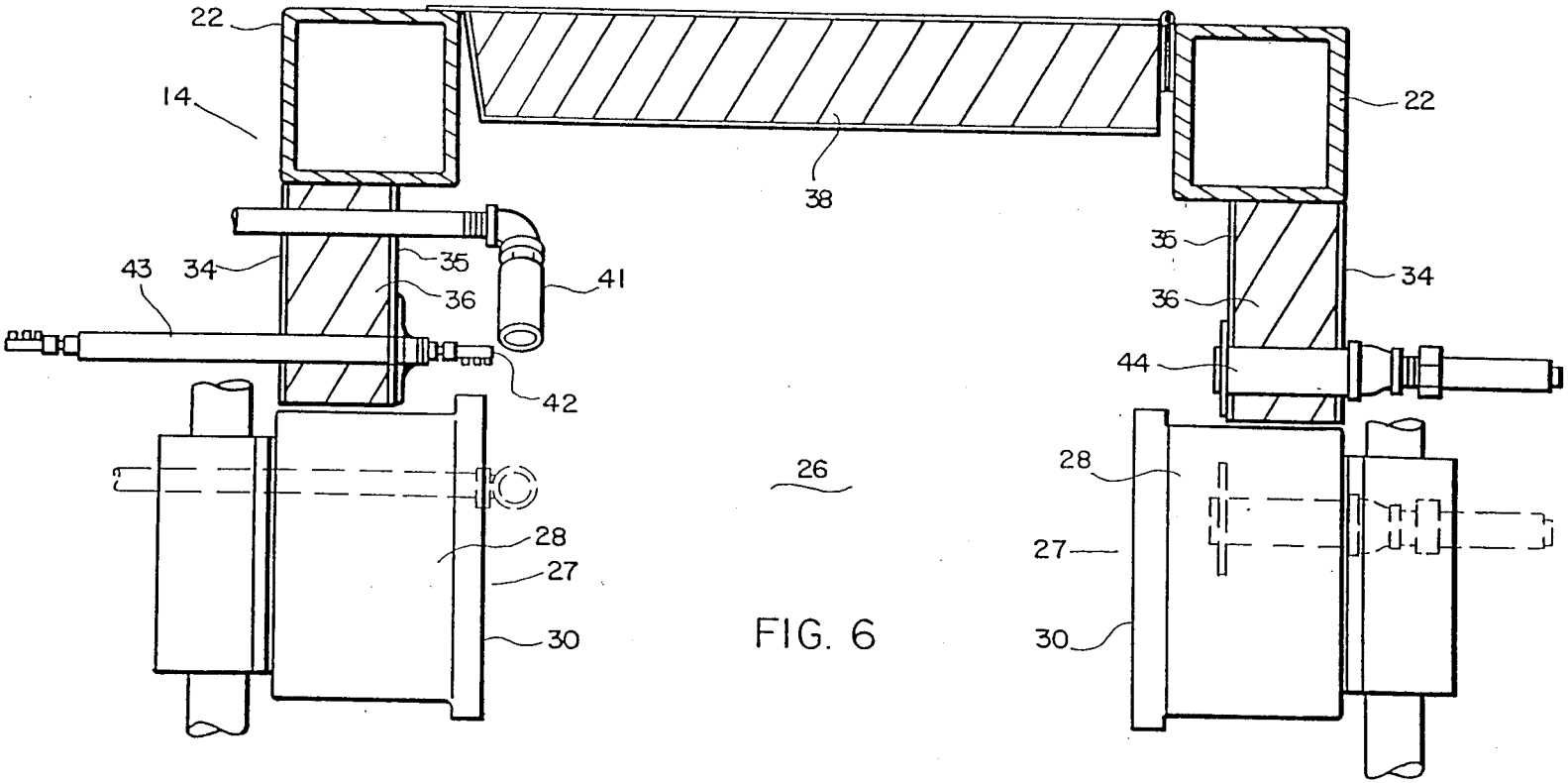
FIG. 6 is an enlarged horizontal section of a portion of a chamber of the dryer of FIG. 1.

As seen in FIG. 6, the burner units 28 in each row 29 are ignited from a pilot tube 41 at the end of the row, with the pilot tube 41 discharging gas toward the burner units 28 across a spark plug 42 connected to a power source through an electrode 43. The spark plug 42, when energized, ignites the gas discharging from the pilot tube 41 to ignite gas discharged from the burner units, which ignition progresses across the row of burner units 28. Mounted in the opposite side of the heating chamber 26 directly opposite the discharge of the pilot tube 41 is an electrical scanning unit 44 that senses the presence of a pilot flame at the opposed pilot tube 41 for control of operation of the associated row 29 of burner units 28. The pilot tube 41 and scanning unit 44 may be located at other convenient locations, such as below or above the end burner units 28 as indicated in dash lines in FIG. 6.

Figure 7:
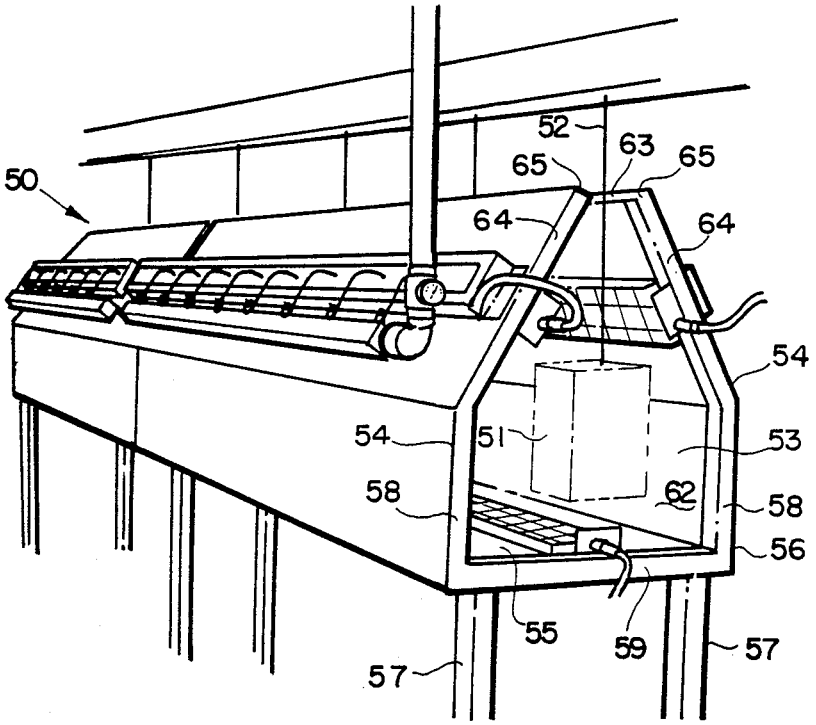
FIG. 7 is a perspective view of an oven according to another preferred embodiment of the present invention.
Figure 8:
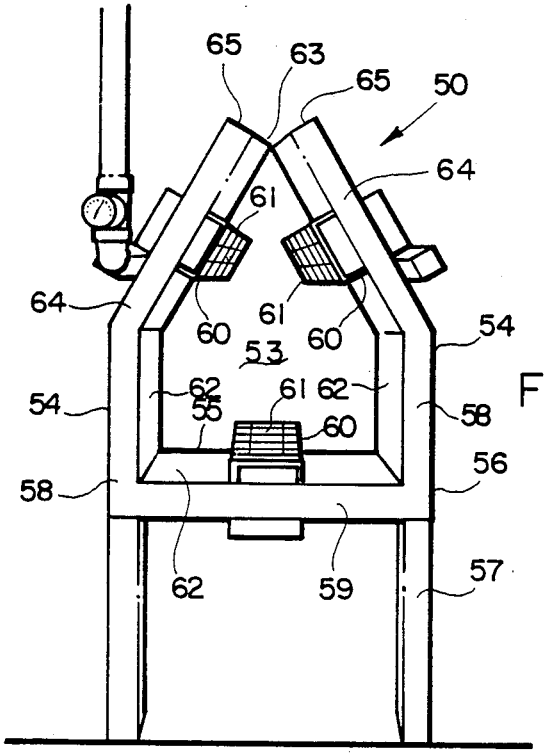
FIG. 8 is a perspective view of the end of the oven of FIG. 7.
Figure 9:
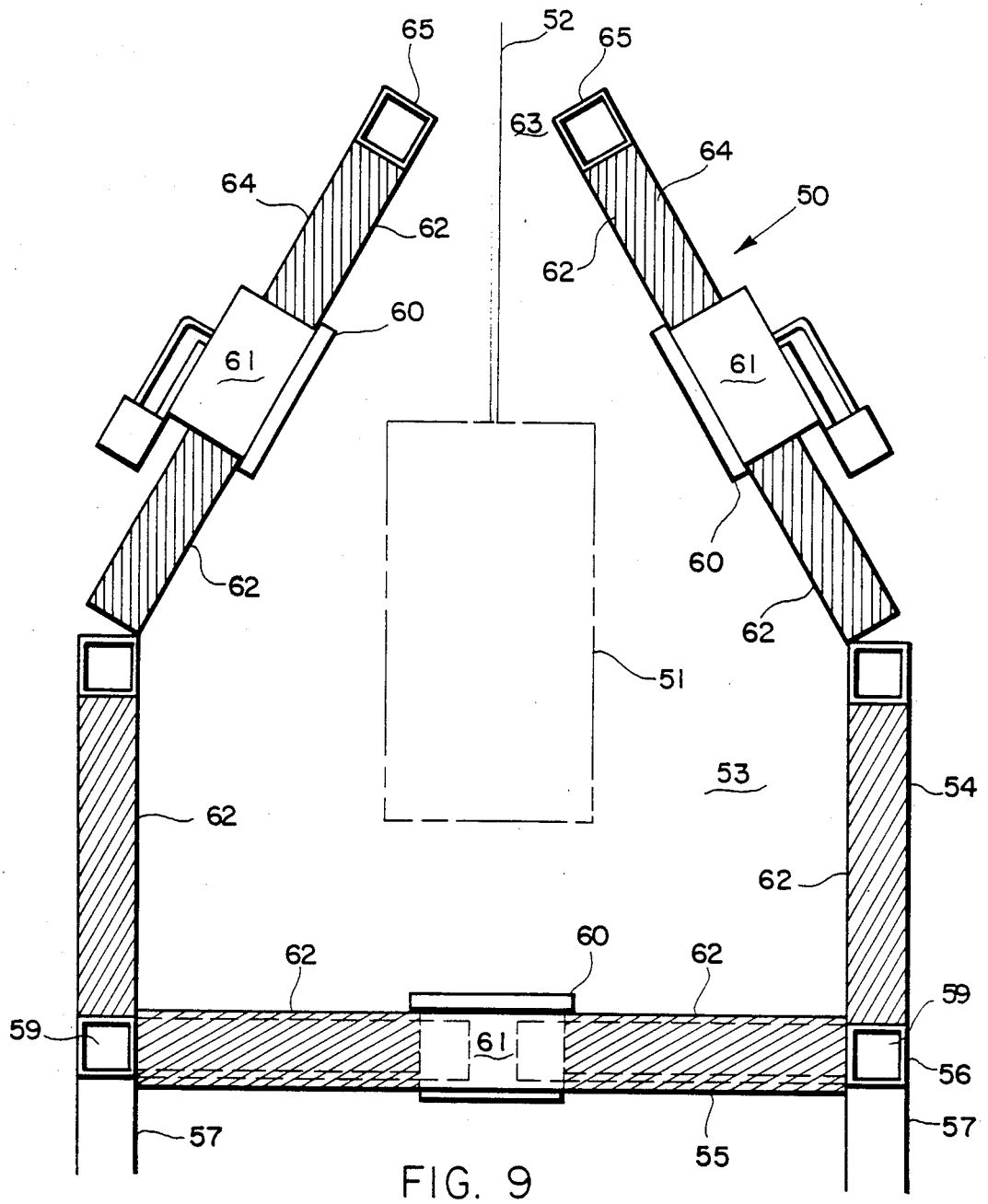
FIG. 9 is a vertical transverse section of the oven of FIG. 7.

Referring now to the embodiment illustrated in FIGS. 7–9, the invention is incorporated in an oven 50 used to heat objects, such as articles 15 of ceramic material that are conveyed horizontally through the oven 50 by suspension from a conveyor 52 of a conventional design.

In this embodiment, the oven 50 is formed with a horizontally extending heating chamber 53 defined between two vertical sides 54 and a bottom side 55. These sides 54 and 55 are formed in a framework 56 supported on legs 57. The framework 56 has end posts 58 and longitudinally extending horizontal channels 59 connecting the end posts 58 and on which rows 60 of burner units 61 are mounted for horizontal extent of the rows 60 with enclosure panels 62 contiguous with and extending from the burner units 61 to form an enclosure for the heating chamber 53 except for a longitudinally extending opening 63 along the top of the oven 50 to accommodate extension of the conveyor 52 into the oven 50 for support of articles 51 therein and to allow exhaust of gases from the oven 50.

The burner units 61 and enclosure panels 62 and their interrelation in construction and re-radiating function are substantially the same as described above in regard to the embodiment of FIGS. 1–6. However, instead of having two closely spaced opposed sides as in the embodiment of FIGS. 1–6, the oven 5 of FIGS. 7–9 has three partially opposed sides, i.e., the two vertical sides 54 and the bottom side 55, with the vertical sides 54 having their upper portions 64 converging upwardly to define the openings 63 at their upper ends 65. The burner units 61 in the vertical sides 54 are disposed in the upper portions 64 and, therefore, face at a downward inclination for directing heat therefrom toward the article 51 being conveyed therebetween. The burner units 61 in the bottom side 55 are located in a centrally extending horizontal row facing upwardly toward the article 51 and the opening 63 such that the heat radiating from this row of burner units applies heat by radiation and also by convection as the gas travels toward the opening 63.

The form of the oven 50 can be varied with different numbers of rows of burner units and different numbers of sides to accommodate different configurations of articles and different desirable heat applications.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A dryer or oven of the type utilizing radiant burners, comprising a supporting framework defining a heating chamber extending therethrough with at least two opposed sides, a plurality of radiant burner units mounted in spaced rows on said framework on opposed sides of the heating chamber, said burner units having burner surfaces facing into said heating chamber and having fuel conduits and control valves disposed exteriorly of said chamber, enclosure panels mounted on said framework substantially contiguous with said rows of burner units between the burner surfaces and the exterior conduits and valves and extending from said rows of burner units to substantially enclose said opposed sides of the heating chamber, said panels in each side of said heating chamber being disposed for receiving heat radiated from burner units in an opposite side of said heating chamber, said panel having a radiantly reflective surface facing interiorly of the chamber and a backing layer of insulating material for reflection off the radiantly reflective surface of said panels and into the chamber of heat from opposed burner units, and means for conveying a substrate through said chamber.

2. A dryer or oven according to claim 1 and characterized further in that opposite rows of burner units are transversely out of facing alignment.

3. A dryer or oven according to claim 1 or 2 and characterized further in that said chamber is formed with two closely spaced opposed sides having rows of burner units therein, thereby providing a narrow chamber through which said substrate is conveyed between burner units and panels.

4. A dryer or oven according to claim 3 and characterized further in that each of said rows of burner units extends transverse to the direction of substrate conveyance.

5. A dryer or oven of the type utilizing radiant burners, comprising a plurality of spaced, parallel modules, each of said modules having a supporting framework defining a heating chamber extending therethrough with at least two opposed sides, a plurality of radiant burner units mounted in spaced rows on said framework on opposed sides of the heating chamber, said burner units having burner surfaces facing into said heating chamber and having fuel conduits and control valves disposed exteriorly of said chamber, enclosure panels mounted on said framework substantially contiguous with said rows of burner units between the burner surfaces and the exterior conduits and valves and extending from said rows of burner units to substantially enclose said opposed sides of the heating chamber, said panels in each side of said heating chamber being disposed for receiving heat radiated from burner units in an opposite side of said heating chamber, means for conveying a substrate sequentially through said modules, said modules being spaced sufficiently to allow access to the burner units exteriorly of said modules for servicing and replacement.

6. A dryer or oven according to claim 5 and characterized further in that said modules have vertically extending sections containing said chambers, with the chamber in each of said modules having two vertically extending opposed sides containing said burner units and between which the substrate is conveyed vertically, and said vertical module sections are arranged in parallel, horizontally spaced relation.

7. A dryer or oven according to claim 6 and characterized further in that said opposed chamber walls in each vertically extending section are closely spaced, thereby providing a narrow chamber through which the substrate is conveyed between burner units and panels.

8. A dryer or oven according to claim 6 or 7 and characterized further in that said modules are T-shaped with horizontally extending upper sections providing horizontally extending exhaust plenum chambers, said upper sections of adjacent modules being connected end-to-end with a resulting access space between adjacent vertically extending sections, said upper sections forming a common exhaust plenum across the top of said oven or dryer.

9. A dryer or oven according to claim 1 and characterized further in that said heating chamber extends generally horizontally and has at least three at least partially opposed sides extending in a generally horizontal direction with a longitudinally extending horizontal upper opening extending between adjacent sides for extension of said conveying means therethrough.

10. A dryer or oven according to claim 9 and characterized further in that said sides adjacent said opening are inclined to dispose the burner units therein to face at a downward inclination.

11. A dryer or oven according to claim 10 and characterized further in that one of said at least three sides is disposed below the substrate and faces upwardly toward said opening.

12. A dryer or oven according to claim 1 and characterized further in that said radiantly reflective surfaces are formed of metal.

13. A dryer or oven according to claim 5 and characterized further in that said panels have radiantly reflective surfaces formed of metal and facing interiorly of the chamber for reflection off the radiantly reflective surfaces of said panels and into the chamber of heat from opposed burner units.

* * * * *